United States Patent [19]

Chagoya

[11] Patent Number: 4,719,824

[45] Date of Patent: Jan. 19, 1988

[54] PULL TAB OPENER

[76] Inventor: Robert Chagoya, 1833 17th St., #2, Santa Monica, Calif. 90404

[21] Appl. No.: 856,176

[22] Filed: Apr. 28, 1986

[51] Int. Cl.[4] ..... B67B 7/44

[52] U.S. Cl. ..... 81/3.09; 81/3.57; 220/274

[58] Field of Search ..... 81/3.55, 3.56, 3.57, 81/3.4, 3.07, 3.09; D8/33, 34, 40; 220/274, 284

[56] References Cited

U.S. PATENT DOCUMENTS

| | | | |
|---|---|---|---|
| 3,235,122 | 2/1966 | Oblander | 220/274 |
| 4,287,794 | 9/1981 | Kubach | 81/3.55 |
| 4,474,087 | 10/1984 | Widman | 81/3.55 |

FOREIGN PATENT DOCUMENTS

| | | | |
|---|---|---|---|
| 2119359 | 12/1972 | Fed. Rep. of Germany | 81/3.07 |

*Primary Examiner*—Roscoe V. Parker
*Attorney, Agent, or Firm*—Lewis Anten

[57] ABSTRACT

A pull tab opener for use on pop-top cans such as are used for beverages having a mounting with fingers gripping the edge of the can opposite the pull tab and a lever arm hinged to the mounting for rotation downward and over the pull tab. The arm has a lip which falls below the periphery of the tab, when the tab is pushed down. When the arm is raised, the lip raises the pull tab above its yield point, but less than that which would break the seal at the opening. Thereafter the can is storable and can be readily opened by the fingers. A yieldably resilient portion of the lever arm is held against the opening in the can by an extension releasably engaging the edge of the can opposite the edge gripped by the fingers.

9 Claims, 7 Drawing Figures

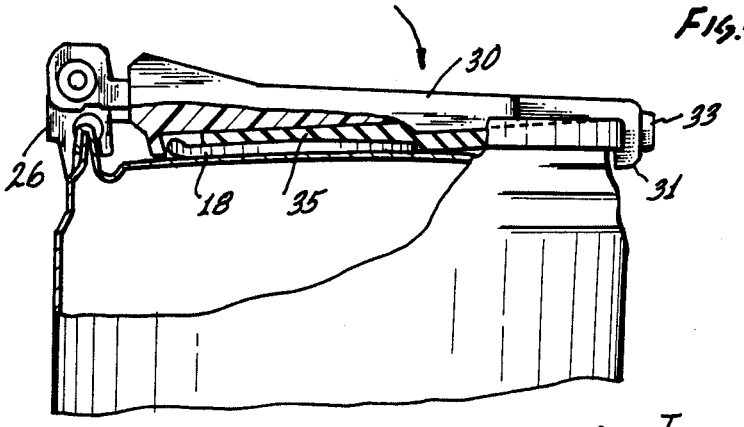
Fig.4
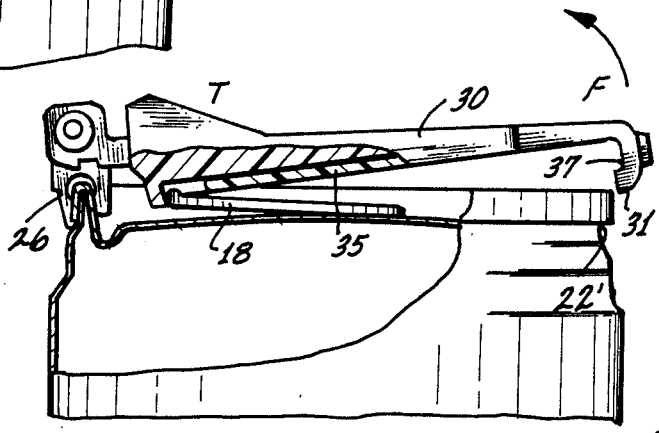
Fig.5
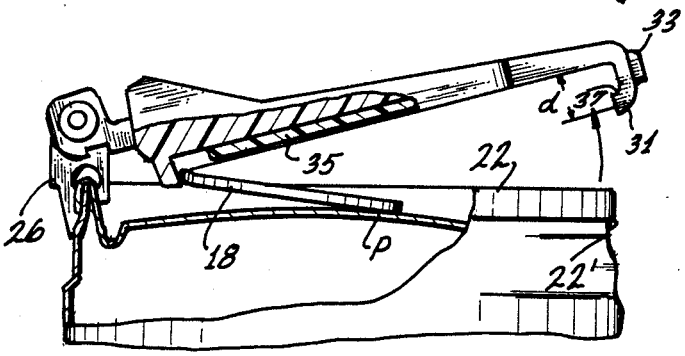
Fig.6
Fig.7
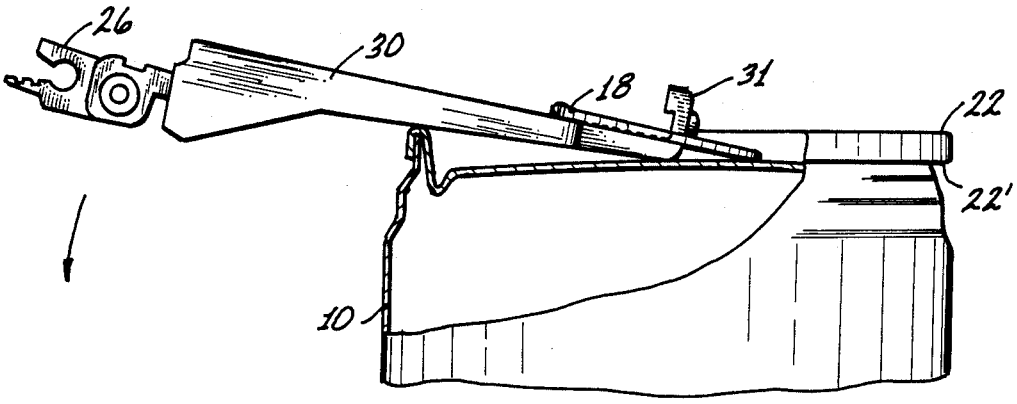

PULL TAB OPENER

BACKGROUND OF THE INVENTION

This invention relates to a device for the opening and sealing of beverage cans and more particularly to an opening tool for springing or crakcing a pop-top pull tab upwardly where they are left ready for easy opening of the can by hand, and then sealing the can after it is opened.

In recent years manufacturers have provided pull tabs so as to enable ready opening of beverage cans commonly used for beer and soft drinks, without the requirement of a separate can opener. Whether of the detachable or retained type, the tabs associated with the pop tops are opened by prying under the tab with the fingernail to lift it enough so as to spring or crack it up into a partially open position and thereafter sliding one's finger into the opening so as to obtain a grip between the thumb and fingers with enough force to either pull the tab off the container or rotate the tab straight up, and breaking the pop-top seal between a weakened portion joining the pop-top with the can top itself.

The prior art includes a number of patents of which U.S. Pat. Nos. 4,474,087 and 4,287,794 are exemplary, in which a tool is provided for engaging and completely opening the pop-top by pulling the tab. Such tools find major use by customers who desire to facilitate this operation for children and for women so as to avoid the breaking of fingernails and for children to avoid other painful experiences prying up the tabs with tender fingers. Provided the person opening the can wants to drink the contents at that time such openers are satisfactory, but, when it is desired to have others, such as children, be able to open a beverage can by hand when they remove it from the refrigerator, then another approach is needed.

Also, once such cans have been opened, particuarly where the tab is retained in place, the contents of the can is not sealable again. It is common practice to stuff paper or some other substance into the opening to keep the fluid in the can. Such a device, however, is not air tight and if soda is in the can it soon becomes flat.

SUMMARY OF THE INVENTION

It is a general object of the present invention to provide a plastic or thin metal tool which enables the tab of a pop-top beverage can to be pulled to the point just short of opening the can in such a way that the tab is sprung beyond its deformation or yield point where it remains raised from the can top, but the can remains sealed. Then anyone can open the can using their fingers without employing fingernails and without finger hurting force. An adult may use the tool of the present invention as a step to be employed to all the cans being loaded into a refrigerator, for example, at one time, so that when they are later removed, they are readily opened by anybody.

The present invention provides a tool to supply the force required for the initial movement of the tab, moving it to overcome the initial resistance and then sufficiently far that the juncture between the tab and the section attached to the top finally yields so as to thereafter the tab remains lifted a short distance spaced above the can top. It is found, as a practical matter, that the tool of the present invention premanently cracks the tab upwardly beyond this yield point, in such a way as to not open the can. Thus, the can may be stored, refrigerated or otherwise dealt with after the tool has been applied to it, and it will retain its seal, but be readily available to be later opened with ease. This feature results from the tab of the can remaining sprung partially open after it has been carried a sufficient distance from the can top.

Also, the tool has a portion thereof which is deformable and maintained in contact with the can so as to form an air tight seal over the opening in the can once the tab is pulled back far enough to open the can.

The tool of the present invention generally includes a finger mounting means for grasping the rim of the can to which it is hinged, or flexibly attached, an arm which contains an internal lip so arranged that when the arm is pressed over the pull tab, the lip drops below the outer edge of the tab. These clearances are available since the lip and tab are both below the plane defined by the hinging action of the tool of the invention and that of the joint between the pull tab and section attached to the top. Thus when pressed below this plane a sufficient clearance is achieved so that the outer edge of the pull tab drops inside of the lip and is then engaged by the lip for being raised as the tool itself is rotated about the hinge and away from the top. In this way the tool of the present invention automatically releases the tab after the lift motion passes a predetermined angle or height which is designed to be beyond the initial yielding of the tab top juncture so that the tab does not thereafter spring back.

Thereafter, the tab can be readily pulled open by the end of one's finger due to the additional space provided.

The arm has an interior portion having a deformable plastic in the portion of the arm that comes into contact with the opening of the can, the deformable plastic fills the area of the opening when pressed and held against the opening. An extension of the arm releaseably engages the edge of the can opposite the edge of the can nearest the hinge to maintain the deformable plastic in the opening.

These and other objects and features of the invention will become apparent from the following description and the accompanying drawings, of which:

BRIEF DESCRIPTION OF THE DRAWINGS

FIG. 4 is a side elevational view similar to FIG. 2 showing the tool of FIG. 1 closed down over the tab so as to engage the outer lifting edge thereof sealing any opening.

FIG. 5 is a side elevational view similar to FIGS. 2 and 4 showing the lifting of the tool of FIG. 1 as the same is moved in a rotated motion counter to the rotation of the tab.

FIG. 6 is a view similar to that of FIG. 5 showing the upper limit of travel of both the tab and the tool at the point of disengagement at which point the tab is partially stabilized in an open position because it has been carried beyond the yield point of its mounting.

FIG. 7 shows the use of the present invention after having been dismounted from the can and the end of the arm used as a pry under the partially opened tab to more completely lift the same, when fully opening the can, by using the rim of the can as a fulcrum.

DETAILED DESCRIPTION OF THE PREFERRED EMBODIMENT

Figure 1:
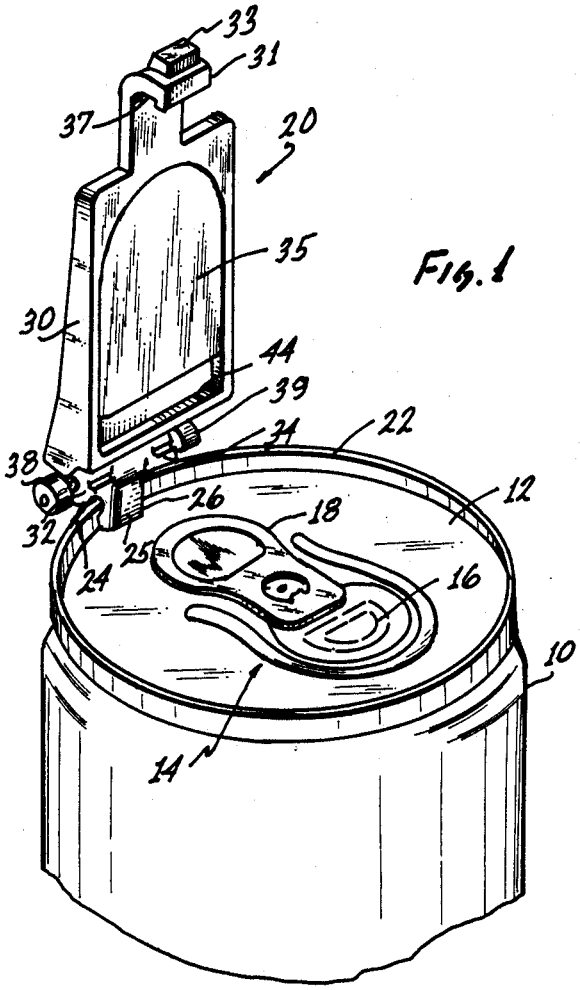
FIG. 1 is a perspective illustration of the tab opening tool of the present invention shown mounted on a can of the type having a pop-top closure.

FIG. 1 shows a can 10 of conventional construction provided with a metal top 12 having a pop-top structure 14. The structure 14 consists of a section 16 formed integrally with the top and having a weakened edge joining the top which when broken forms an opening. The section 16 is adapted to be at least partially broken from the top when the tab is pulled or rotated upwardly and away from the top, thereby opening the can.

Figure 2:
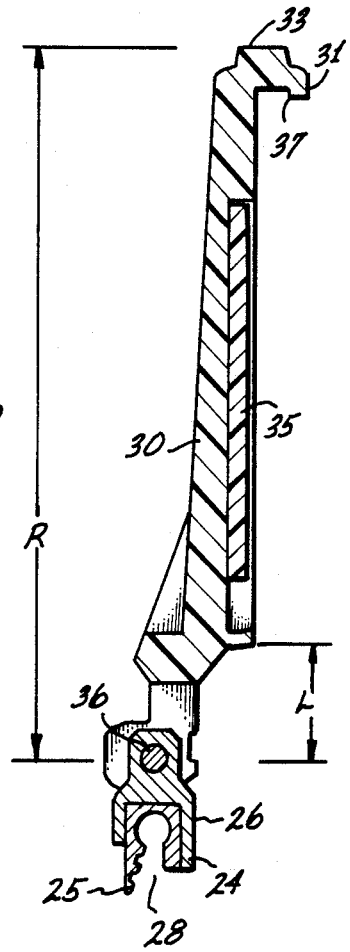
FIG. 2 is a side elevational view partially broken away in cross-section showing the tool of FIG. 1.

A tab lifting tool 20 constructed in accordance with the present invention is shown mounted on the rim of the can directly opposite the tab 18 of the structure 14. The tool 20 includes a pair of opposed fingers 24–25 extending as a portion of a rigid, metal mounting 26 and thus forming a downwardly facing opening 28 for attaching over and grasping the rim 22 (as shown in detail in FIGS. 2 and 3) to form means for mounting the tool to the rim or edge of the can.

A lever of arm 30 is attached to the part 26 by a hinge or other flexible means allowing the user to move the arm 30 to a position lowered over the tab 18 to an even lower position pressed down so as to permit a portion of the arm to engage the outer end of the tab, as will be described. Preferably, the flexible means or hinge is provided with some return force or friction means so that the device stays where it is put. Such means can be made by providing an interference fit or between the parts, as where lugs 32, 34 are connected to the mounting structure 26 by a threaded hinge pin 36 and end nuts 38, 39, as shown. By taking up the end nuts 38, 39 a suitable friction can be established.

The arm 30 is long enough, at R, to provide good working distance for finger manipulation, assuming that the thumb, T rests near the end of the arm 30 proximate the mounting 26 (FIG. 5) and the fingers are working the remote end, at F in FIG. 5.

At the end of arm 30 is an integral flexible curved grasping member 31. The grasping member 31 has lip portion 37 for yieldably engaging the lower edge 22' of edge 22. A tapered projection portion 33 extends in line with the arm. Within arm 30 is a deformable plastic or putty-like material 35 which is positioned in arm 30 so that when the arm 30 is in its lowered position it covers the section 16 in an air tight manner.

Figure 3:
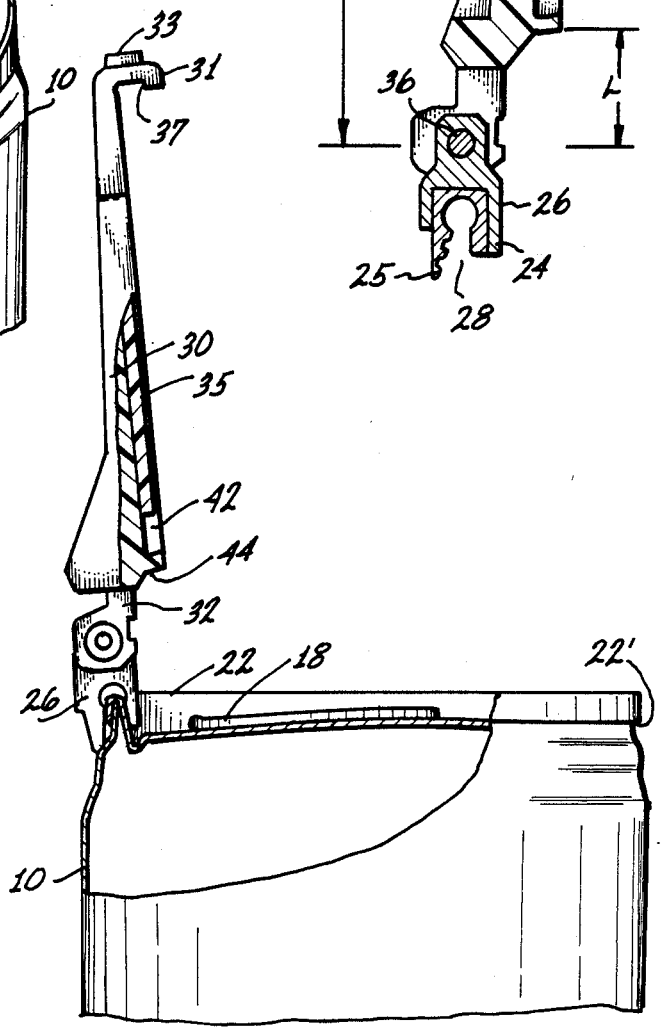
FIG. 3 is a side elevational cross-sectional view through the spring tool taken along the lines 3—3 of FIG. 1.

In FIG. 3 the lifting tool is shown pushed down over the rim of the can whereon it is self-supported due to the friction in the hinge.

The arm 30 has an interior recess 42 for enclosing the entire tab. The recess 42 terminates at the inner or hinged side in a downwardly extending lip 44 whch slightly overlaps the tab by a small amount when the tab and arm lie in parallel planes, but which just clears the tab when the arm and lip are pushed down.

In FIG. 4 the arm has been rotated over the pull tab and pressed down compresing the tab into the top until the additional clearance created by this movement allows the lip to snap past the tab periphery, after which the tab acts as a short sping to return the arm back up to a position where it is easily grasped at its end.

In FIG. 5 the lifting motion has begin by pulling up in the direction of the arrow, the lip thereby lifting up the tab as the arm is moved with the given mechanical advantage.

In FIG. 6 the geometric limit of upward pull is almost reached. This limit is established by the upper limit of interference between the rotation circles of the tab about the point p and the arm about the hinge. This is enough to carry the tab upwardly beyond its yield point so that it will stay up after it is lifted this far and released.

FIG. 7 shows another use of the tool of the invention, in which it is removed from the can and uses a pry bar underneath the already lifted tab, with the rim of the can as a fulcrum.

The following dimension of the tab lift tool of the invention are found to make it suitable for a wide variety of twelve ounce beverage cans, effective length of arm, R, equals 55 mm,
effective length of lip, L, equals 11 mm,
depth of recess, d, equals 4 mm.

The ratio of the lengtH of the arm (R) to that of the lip (L) namely R/L (referenced to the hinge, as shown in Figure), is the mechanical advantage of this tool and is about 5. Generally, a meechanical advantage of at least about 2 is preferred, although a greater number up to about 5 is readily and usefully achieved.

In operation the fingers are fitted over the edge of the can in alignment with the tab of the can, proximate the side of the tab with the pull portion. The arm is pivoted downward pressing the arm against the tab as far as it will go. The arm is then lifted, resulting in the tab being cracked. The fingers are then removed and the projection on the other end of the arm is slid under the tab, and using the edge of the can as a fulcrum, the end of the arm opposite the tab is pushed down causing the tab to pop open.

If only a portion of the contents of the can is used, the fingers are placed back on the can in the original position and the arm then pressed down again until the grasping means engages the bottom of the edge of the can, the Yieldable plastic portion filling the opening in the can and forming an air tight seal. To open the can again the grasping means is pulled outward and upward until it releases the bottom edge of the edge.

To those skilled in the art to which this invention pertains, many modifications and improvements will occur without departing from the spirit and scope thereof, which is limited solely by that of the accompanying claims.

What is claimed is:

1. A tool for partially opening the pull tab of a pop top can comprising means for mounting the tool onto the rim or edge of the can on the side opposite the opening, a lever arm, means for flexibly connecting the arm to the mounting means so that the arm can be generally rotated about the edge of the can downwardly and over the pull tab, said lever being long enough for easy movement by hand and longer than the distance from the container edge to the outer end of the pull tab to provide meachanical advantage, means forming a recess and lip within the lower side of the arm so that the lip extends just slightly beyond the outer edge of the pull tab so that the user, in pushing down on the arm, pushed the tab downward toward the can which allows the lip to fall below the pull tab after which raising of the arm by the user lifts the lip and tab upwardly in counter-rotating motions and beyond the yield point of the tab before the lip disengages it, thereby leaving the tab sprung open for being easily pried open with the fingers.

2. Claim 2 as in claim 1 further in which the ratio of the length of the arm to the effective length of the lip from the flexible connection means is greater than about 2.

3. The lifting tool as in claim 2 wherein said ratio is about 5.

4. The tool as in claim 1 wherein the flexible connecting means is a simple hinge having a sufficient friction to support the arm in an arbitrary position.

5. The tool as in claim 1 wherein said mounting means includes a block of metal having a slot in the bottom edge for defining a pair of fingers for sliding over the rim of a can, said slot having a length tangent to the rim short enough that, in combination with its depth, allows the same to fit snugly over the rim.

6. The tool as in claim 1 in which said lever has a grasping means at the opposite end of the arm having the mounting means.

7. The tool of claim 6 in which said grasping means is integral with said arm.

8. The tool of claim 6 in which said grasping means is adapted to engage the lower edge of the lip of the can.

9. The tool of claim 1 in which said arm includes a deofrmable plastic material for engagement with an opening in said can.

* * * * *